US005794962A

United States Patent [19]

Bardin et al.

[11] Patent Number: 5,794,962

[45] Date of Patent: Aug. 18, 1998

[54] LONGITUDINALLY ADJUSTABLE BASE FOR SKI BINDING

[75] Inventors: Roland Bardin, Varennes Vauzelles; Michel Thevenet, Coulanges les Nevers, both of France

[73] Assignee: Look Fixations S.A., France

[21] Appl. No.: 717,693

[22] Filed: Sep. 23, 1996

[30] Foreign Application Priority Data

Oct. 10, 1995 [FR] France ..... 95 12112

[51] Int. Cl.[6] ..... A63C 9/00

[52] U.S. Cl. ..... 280/607; 280/620; 280/633

[58] Field of Search ..... 280/607, 618, 280/620, 636, 633, 634; 441/70

[56] References Cited

U.S. PATENT DOCUMENTS

| | | | |
|---|---|---|---|
| 4,302,027 | 11/1981 | Himmetsberger et al. | 280/618 |
| 4,310,170 | 1/1982 | Linecker | 280/636 |
| 4,394,032 | 7/1983 | Storandt et al. | 280/618 |
| 4,506,905 | 3/1985 | Krob et al. | 280/633 |
| 4,699,397 | 10/1987 | Freisinger et al. | 280/633 |
| 4,773,886 | 9/1988 | Teeter et al. | 441/70 |
| 4,861,064 | 8/1989 | Stritzl et al. | 280/618 |
| 4,955,633 | 9/1990 | Stritzl et al. | 280/633 |
| 5,085,456 | 2/1992 | Horn | 280/618 |
| 5,096,218 | 3/1992 | Bardin | 280/633 |
| 5,116,073 | 5/1992 | Goud | 280/617 |
| 5,348,335 | 9/1994 | Dasarmaux et al. | 280/633 |

FOREIGN PATENT DOCUMENTS

| | | |
|---|---|---|
| 368 394 | 11/1993 | Austria . |
| 2 632 200 | 12/1989 | France . |

*Primary Examiner*—Brian L. Johnson
*Assistant Examiner*—Bridget Avery
*Attorney, Agent, or Firm*—Kane, Dalsimer, Sullivan, Kurucz, Levy, Eisele and Richard, LLP

[57] ABSTRACT

A base intended to receive a ski binding thereon, said base comprising a slider (1) fixed to the ski, with a row of notches (4) parallel to the axis of the slider, and a fitted plate (5) sliding onto the slider, with a latch (6) engaged, by the action of a spring, in a notch of the slider, in such a way as to immobilize the plate on the slider, as well as a release lever (13). The latch (6) consists of a fitted part separate from the lever, sliding transversally to the plate, and the base also comprises a mobile element, like a shoe (16) which removes play between the plate and the slider, and may be moved to an active or inactive position by action on the release lever.

6 Claims, 4 Drawing Sheets

FIG.7
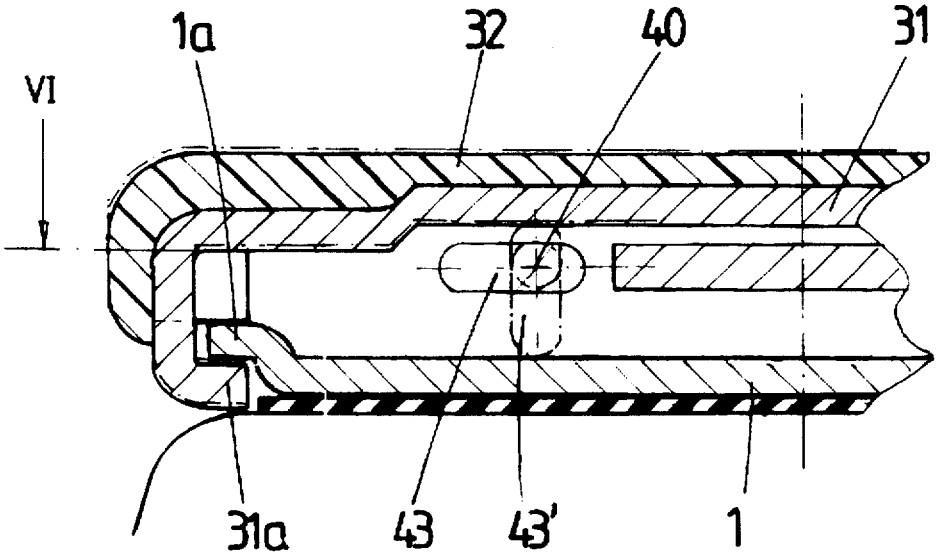
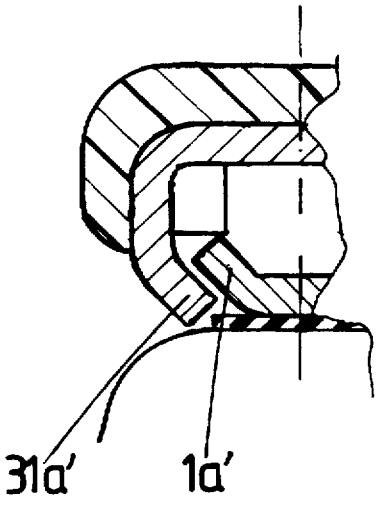
FIG.8

LONGITUDINALLY ADJUSTABLE BASE FOR SKI BINDING

FIELD OF THE INVENTION

The object of this invention is a base intended to receive a ski binding thereon, said base being longitudinally adjustable and comprising a slider fixed to the ski, with a line of notches parallel to the axis of the slider and a fitted plate, sliding on the slider, bearing a spring-operated latch which engages in at least one of the notches on the slider, in such a way as to immobilize the plate on the slider, as well as a fitted release lever pivoting on the plate around an axis perpendicular to the plate.

PRIOR ART

Such bases are used to equip top of the range demonstration and hiring skis in order to allow the distance between the front binding and the rear binding to be quickly adjusted to the size of the user's footwear, while maintaining the center of the footwear at the same point on the ski. For this purpose, both the front binding and the rear binding must be moved when changing the size.

A similar base is known, in which the latch comprises teeth formed directly on the release lever on which the spring acts directly. Taking account of manufacturing and fitting tolerance limits of such a base, the plate which supports the binding presents a transverse play, which although slight, is still perceptible by the skier when changing edge. Not only is such play unacceptable for top of the range skis, but it gives the skier a sense of inaccuracy in the controlling of the skis.

SUMMARY OF THE INVENTION

The aim of the invention is to remove this play.

The base according to one embodiment is characterized by the latch which consists of a fitted part separate from the lever, sliding transversally to the plate and in which the above-mentioned base also includes a mobile element for removing the play between the plate and the slider, this mobile element being moved by action on the above-mentioned release lever.

According to one embodiment, the element which removes the play consists of a sliding shoe, operated by the release lever, by means of a knuckle joint.

According to another embodiment, the play is removed by means of a cam moving the plate and the slider vertically one away from the other.

BRIEF DESCRIPTION OF THE DRAWINGS

The appended drawing represents, by way of example, several embodiments of the invention.

FIG. 7 shows a cut-away view in accordance with VII—VII of FIG. 6.

FIG. 8 is a partial view of a variant of the second embodiment.

DESCRIPTION OF THE PREFERRED EMBODIMENT(S)

Figure 2:
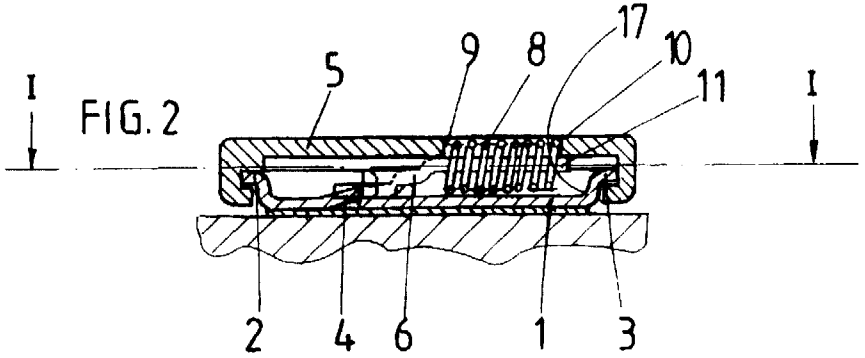
FIG. 2 is a cutaway drawing according to II—II of FIG. 1.
Figure 1:
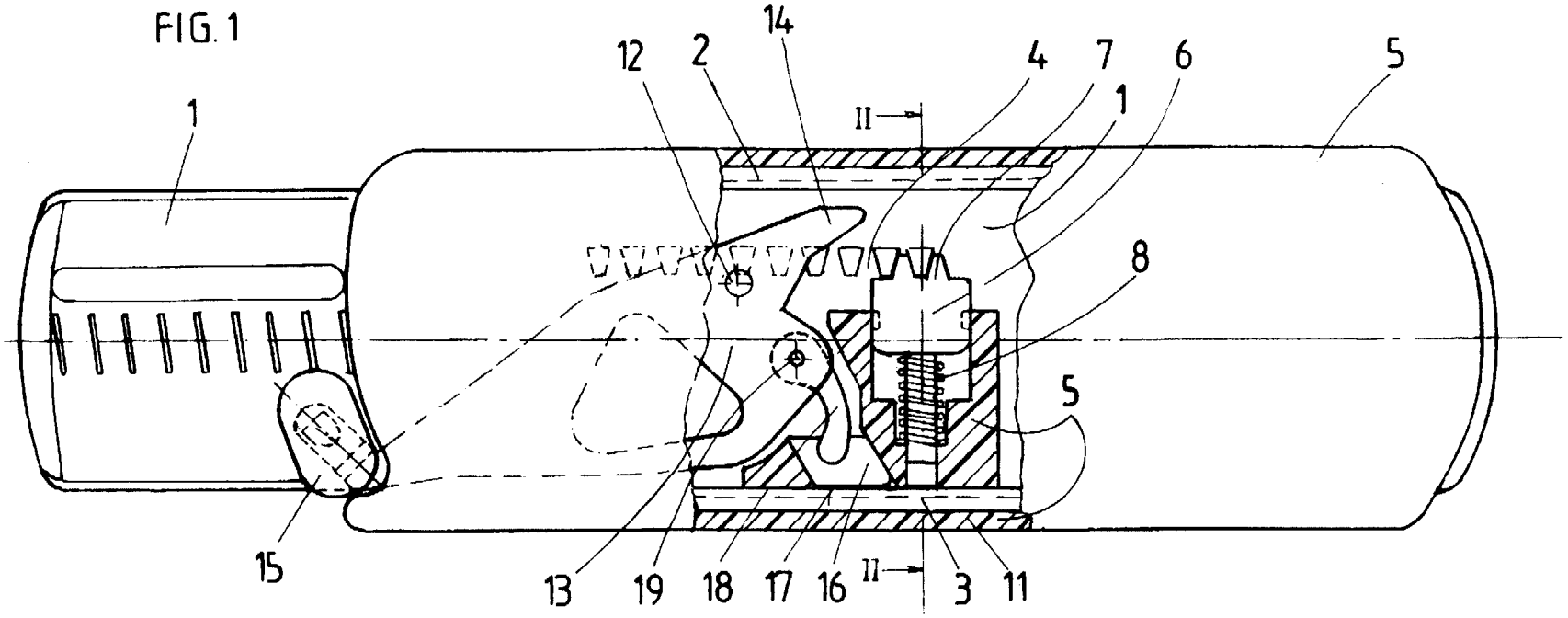
FIG. 1 is a plan drawing of a base according to a first embodiment of the invention.

The base represented in FIGS. 1 and 2 includes a slider 1 consisting of a metal plate, cut and folded in such a way that along part of its length, the edges 2 and 3 are lifted up in such a way as to form the slider proper, as is shown in FIG. 2. In the body of this slider 1, a row of trapezoid notches 4 is formed by stamping. On the slider 2 a plate 5 is fitted on which the ski binding is fixed, in the example under consideration, a front binding. The plate 5 is a moulded plate with grooves and guides on its lower surface.

In FIG. 1, the plate 5 has been partially taken out in such a way as to allow the locking and play compensation mechanisms to be seen. Locking is ensured by a latch 6 which consists of a fitted part sliding transversally in a groove on the lower surface of the plate 5. This latch 6 is fitted with two trapezoid teeth 7 which engage between at least two notches 4 on the drive of a spring 8 which penetrates laterally into a cutout 9 on plate 5, and provides compression between the latch 6 and the edge 10 of the cutout 9. The latch 6 has an arm 11 which crosses the spring 8.

On the lower surface of the plate 5, a lever 13 is also fitted, pivoting around a shaft 12, and fitted at one end with a lip 14 and at the other end with a handle 15 accessible to operate the lever 13. The lever 13 is also linked kinematically to a fitted shoe 16 sliding obliquely in a groove provided in the lower surface of plate 5 and opening on the side of plate 5 opposite to the latch 6, at the level of the vertical edge 17 of slider 1 (FIG. 2), by a slightly curved link rod 18, articulated on lever 13 around a shaft 19 and forming a knuckle with lever 13.

FIG. 1 shows the base in the locked position and with play removed. In this position, the shaft 19 is slightly to the right of the straight line linking the shaft 12 to the articulation of the link rod 18 on the shoe 16. The link rod 18 is slightly bent elastically in such a way that the shoe 16 is pressed against the side of the slider 1, so that the plate 5 cannot be moved laterally on slider 1. This blockage also has the effect of removing vertical play.

If the user wishes to release the plate 5 axially relative to slider 1, the lever 13 must be pivoted in the clockwise direction. During this pivoting action, one must first of all exert sufficient force to pass through the hard point of the knuckle. The lip 14 then pushes back the latch 6 in such a way to release the teeth of the notches 4. As soon as the lever 13 is released, the spring 8 pushes the latch once more into the notches 4. To remove the play, the lever 13 is then pushed back into the position represented in the drawing.

It is noted that the shoe 16 rests obliquely against the slider in such a way that the reaction thus caused presents a parallel component to the axis of the slider. The effect of this component is to remove the axial play which may exist. Moreover, if the teeth 7 happen to stop against the teeth formed between the notches 4, when the release lever is released, this axial component encourages the teeth 7 to engage on the notches.

The three phases described above are illustrated by FIGS. 3, 4 and 5, which at the same time represent a variant of the first embodiment.

Once again, a fitted latch 20 is represented sliding transversally, and equipped with two teeth which engage in the teeth 21 of the slider, under the drive of a spring 22. This latch has a lip 23 and a heel 24 close to the teeth. A release lever 25 is articulated around a shaft 26 and it is linked to a shoe 27, similar to the shoe 16, by a link rod 28.

Figure 3:
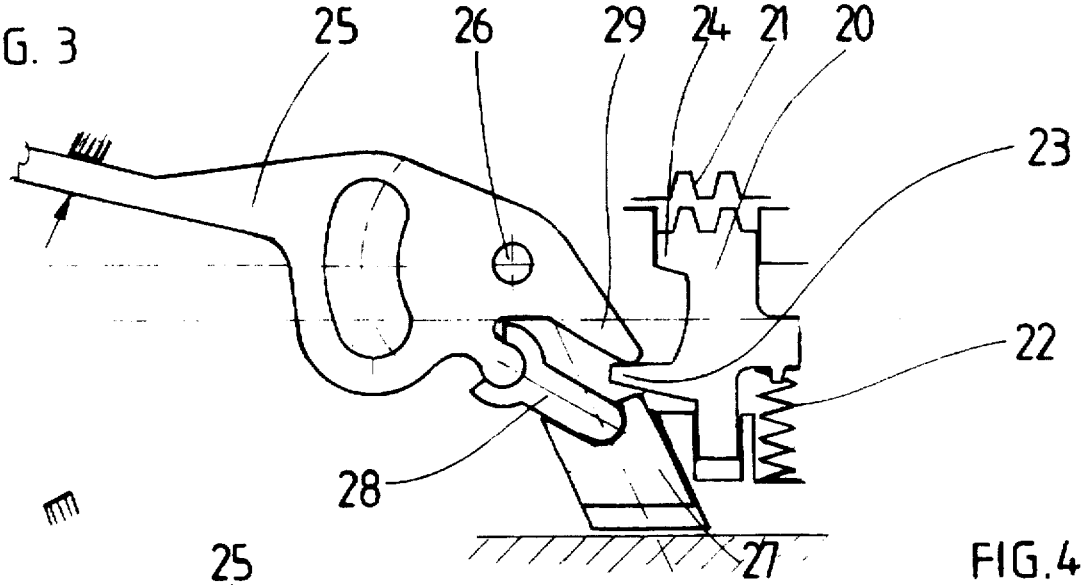
FIGS. 3, 4 and 5 illustrate, by means of a variant of the embodiment, the functioning of the first embodiment.

FIG. 3 shows the device in the released position, a force being exerted on the lever 25 as shown by the arrow. In this position, a lip 29 of the lever 25 pushes back the latch 20 by its lip 23, compressing the spring 22.

When the lever 25 is released, the spring 22 pushes back the latch 20 into a locked position. The lever 25 takes a median position (FIG. 4).

Figure 4:
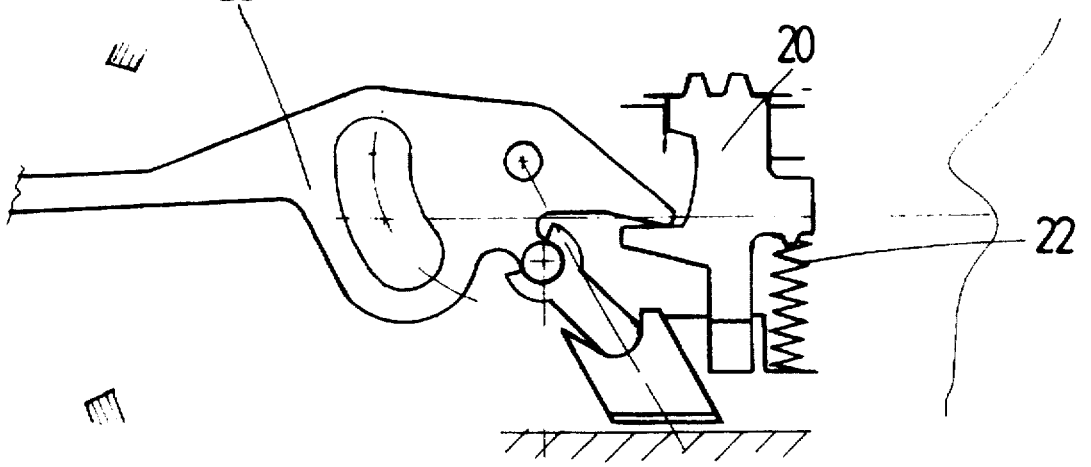
Figure 5:
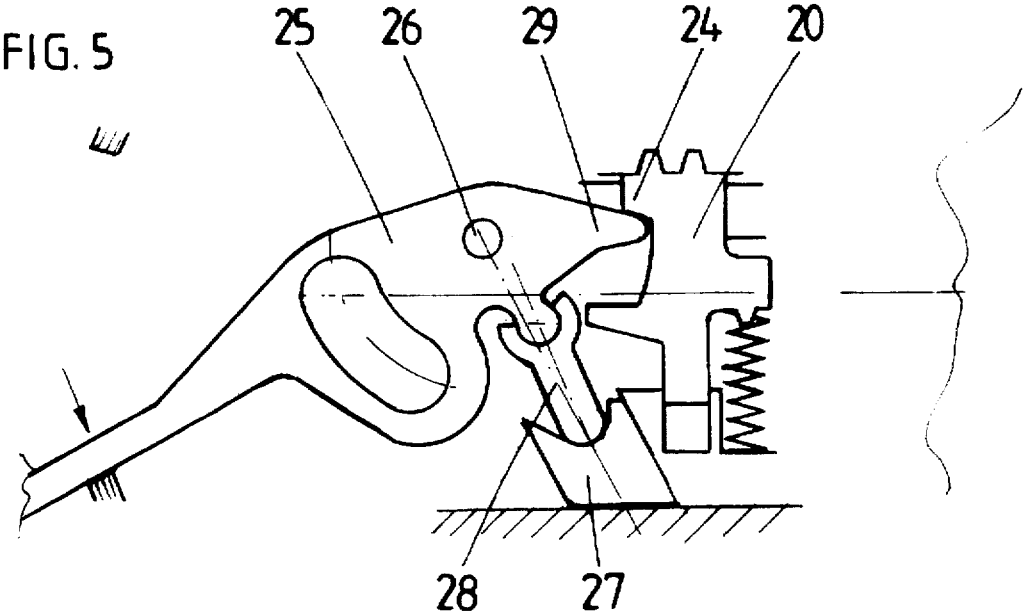

From the position shown in FIG. 4, if the lever 25 is pushed back from the other side, as shown in FIG. 5, the knuckle formed by the link rod 28 articulated on the lever 25 presses the shoe 27 against the slider and the knuckle 28, which has passed through the hard point, is blocked in this position. The lip 29 of lever 25 also comes at least approximately in contact with the heel 24 of the latch 20, thus in turn locking the latch 20. The heel 24 also prevents the system being locked when the teeth of latch 20 are not engaged in the notches.

Figure 6:
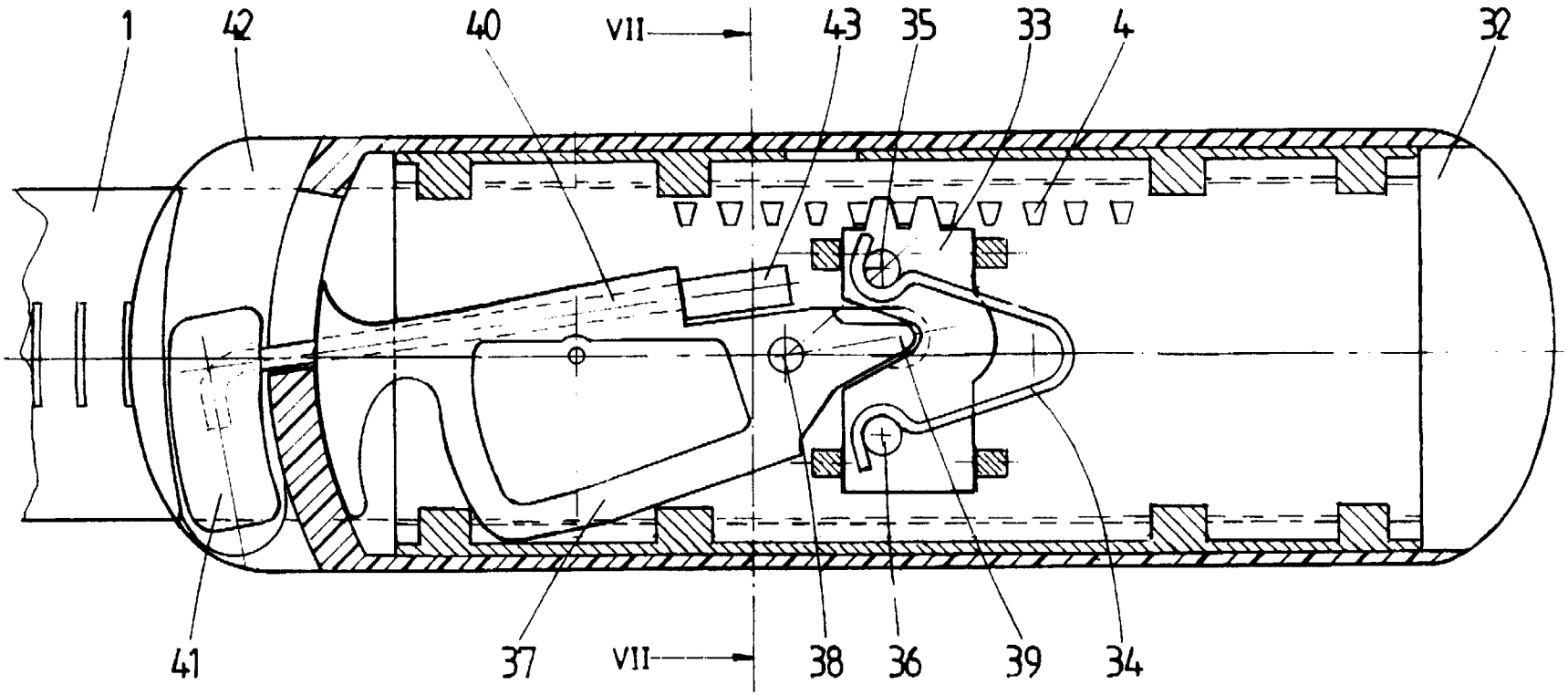
FIG. 6 is a plan drawing of a second embodiment in which the plate above has been cut way to reveal the mechanism for locking and removal of play.

The play may be removed in a way which is significantly different, as is shown by the second embodiment shown in FIGS. 6 and 7.

This embodiment consists of a slider 1 identical to the first embodiment. On this slider 1 a metal plate 31 is fitted, covered here with a sleeving 32 in a synthetic material. A latch 33 is pushed into the notches 4 of the slider by a spring 34 working in deflection between a block 35 of latch 33 and a block 36 of plate 31. The latch 33 may be operated by a fitted lever 37 pivoting around a shaft 38 and provided with a lip 39 which engages in a V-shaped cutout of the latch 33. This latch is thus effectively articulated at the end of lever 37.

The lever 37 is crossed by a shaft 40 extended parallel to plate 31 and provided, at one end, with a paddle-shaped handle 41, and at the other end, with a cam 43 formed or joined onto shaft 40.

In the position shown in FIG. 6, the paddle-shaped handle 41 is folded down into a groove 42, provided for this purpose in the upper surface of plate 32 and the cam 43 is orientated perpendicular to plate 31, as shown in the mixed line at 43' in FIG. 7, in such a way that it moves plate 31 away from slider 1. The effect of this is to press the edges 31*a* of plate 31 hard against the edges 1*a* of the slider 1. This metal to metal contact immobilizes plate 31 by friction onto the slider, removing all play, both lateral and vertical.

The play may be removed without using friction forces if the edges 1*a* and 31*a* are given a certain gradient, as shown in FIG. 8 where these edges are labelled 1'*a* and 31'*a*.

To release plate 31, simply lift the handle 41 perpendicularly to the fixing base, thus allowing the lever 37 to be operated by means of handle 41. The latter is then folded down once more into groove 42.

Handle 41 may be replaced by any other handle allowing to drive the assembly of the release lever in rotation and the shaft 40 in rotation.

We claim:

1. A base intended to receive a ski binding thereon, said base being longitudinally adjustable, including a slider (1) fixed to the ski and having an interior side, with a row of notches (4; 21) parallel to the axis of the slider and a fitted plate (5; 31) sliding on the slider and bearing a latch (6; 20; 33) engaged, through the action of a spring, in at least one notch of the slider, in such a way as to immobilize the plate on the slider, as well as a fitted release lever (13; 25; 37) pivoting on the plate around a shaft perpendicular to the plate, wherein the latch (6; 20; 33) comprises a fitted part separate from the lever, sliding transversely to the plate, and in which the binding base includes a mobile part (16; 27; 43) for removal of play between the plate and the slider, the mobile part being mounted in such a way to be moved by action on the release lever.

2. Base according to claim 1, wherein the mobile part for removal of play comprises a fitted shoe (16; 27) sliding relative to the plate at the level of the interior side of the slider, opposite to the notches, and in which the lever (13; 25) is linked kinematically to the shoe by a link rod (18; 28) forming a knuckle with the release lever, such that the shoe is pressed against the slider and held there when the release lever is pushed hard when in a position opposite to a release position.

3. Base according to claim 1, wherein the release lever is in two parts (37, 40), one of these parts formed from a fitted rotating shaft (40), parallel to the plane of the plate (31) in the other part, and acting as a lever-operating arm, the play removal element comprises a cam (43) fitted or formed on the shaft, this shaft being provided with a handle acting, on one hand, to drive the release lever, and on the other, to rotate the cam to a position in which the cam moves the plate and the slider vertically one away from the other, in such a way that the plate is blocked in the slider.

4. Base according to claim 2, wherein the link rod (18) is curved.

5. Base according to claim 2, wherein the release lever (25) is adapted to come substantially into contact with a boss (24) of the latch, in such a way as to lock the latch.

6. Base according to claim 3, wherein the slider and the plate present oblique edges (1'*a*, 31'*a*) which press one against the other in the blocked position.

* * * * *